US011060257B2

(12) United States Patent
Cowen et al.

(10) Patent No.: US 11,060,257 B2
(45) **Date of Patent: *Jul. 13, 2021**

(54) POLYURETHANE FOAM IN FOUNDATION FOOTINGS FOR LOAD-BEARING STRUCTURES

(71) Applicant: Royal Adhesives & Sealants Canada Ltd, Toronto (CA)

(72) Inventors: Scott W. Cowen, Guelph (CA); Neil G. Goodman, Brampton (CA)

(73) Assignee: Royal Adhesives & Sealants Canada Ltd., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/921,503

(22) Filed: Jul. 6, 2020

(65) Prior Publication Data

US 2020/0332489 A1 Oct. 22, 2020

Related U.S. Application Data

(60) Division of application No. 16/434,531, filed on Jun. 7, 2019, now Pat. No. 10,738,435, which is a continuation of application No. 15/014,616, filed on Feb. 3, 2016, now Pat. No. 10,364,544, which is a continuation-in-part of application No. 14/318,816, filed on Jun. 30, 2014, now abandoned.

(60) Provisional application No. 61/928,453, filed on Jan. 17, 2014.

(51) Int. Cl.
*E02D 27/42* (2006.01)
*E02D 27/00* (2006.01)

(52) U.S. Cl.
CPC ..... *E02D 27/42* (2013.01); *E02D 27/00* (2013.01); *E02D 2300/0046* (2013.01)

(58) Field of Classification Search
CPC ..... E02D 27/42; E02D 27/00; E02D 5/46; E02D 2300/046; E02D 2300/0046
USPC ..... 52/169.1, 169.9, 297, 309.7, 309.4, 52/169.13, 170
See application file for complete search history.

(56) References Cited

U.S. PATENT DOCUMENTS 3,235,446 A * 2/1966 Shelanski ..... C08J 9/40 424/405
3,403,520 A * 10/1968 Goodman ..... E02D 7/00 405/303
3,501,564 A * 3/1970 Golding ..... C08J 5/00 264/255
3,611,736 A * 10/1971 Goodman ..... E04H 12/2292 405/231

(Continued)

FOREIGN PATENT DOCUMENTS

ES 2023321 A6 * 1/1992

*Primary Examiner* — Brent W Herring
(74) *Attorney, Agent, or Firm* — Daniel Barta; Kirsten Stone

(57) ABSTRACT

Foundation footing system for a load-bearing structure comprising a hole in the ground and a post in the hole extending above the hole. A gap present between the sides of the post and the sides of the hole contains a cured, hydrophobic, closed-cell, polyurethane foam to firmly hold the post in place and protect the post from moisture. Alternatively, a foundation footing system for a load-bearing structure comprising a hole in the ground filled with a cured, hydrophobic, closed-cell, polyurethane foam and a post place on and connected to the top of the foam.

16 Claims, 12 Drawing Sheets

(56) References Cited

U.S. PATENT DOCUMENTS

| | | | | | |
|---|---|---|---|---|---|
| 3,632,533 | A * | 1/1972 | Winkler | C08L 25/18 | 521/75 |
| 3,736,759 | A * | 6/1973 | Blose | E02D 5/60 | 405/216 |
| 3,931,450 | A * | 1/1976 | Patton, Jr. | B32B 27/40 | 428/319.7 |
| 3,968,657 | A * | 7/1976 | Hannay | E02D 5/226 | 405/232 |
| 5,398,478 | A * | 3/1995 | Gordin | E04C 3/30 | 52/169.13 |
| 5,466,094 | A * | 11/1995 | Kirby | C08G 18/08 | 405/231 |
| 7,413,385 | B2 * | 8/2008 | Moroschan | E02D 3/08 | 405/229 |
| 8,277,556 | B2 * | 10/2012 | Berke | C04B 28/04 | 106/644 |
| 10,364,544 | B2 * | 7/2019 | Cowen | E02D 27/00 | |
| 10,738,435 | B2 * | 8/2020 | Cowen | E02D 27/42 | |
| 2004/0248761 | A1 * | 12/2004 | Booten | C11D 17/0017 | 510/470 |
| 2005/0081459 | A1 * | 4/2005 | Moroschan | E02D 3/08 | 52/169.1 |
| 2007/0275173 | A1 * | 11/2007 | Lawson | C09K 8/518 | 427/386 |
| 2010/0310846 | A1 * | 12/2010 | Berke | C04B 28/04 | 428/219 |
| 2012/0189838 | A1 * | 7/2012 | Pellacani | B32B 5/20 | 428/314.4 |
| 2013/0008096 | A1 * | 1/2013 | Griffiths | E01F 9/635 | 52/99 |
| 2013/0241098 | A1 * | 9/2013 | Anjum | E04B 1/78 | 264/46.6 |

* cited by examiner

Fibre Tube Poured
Concrete Footing

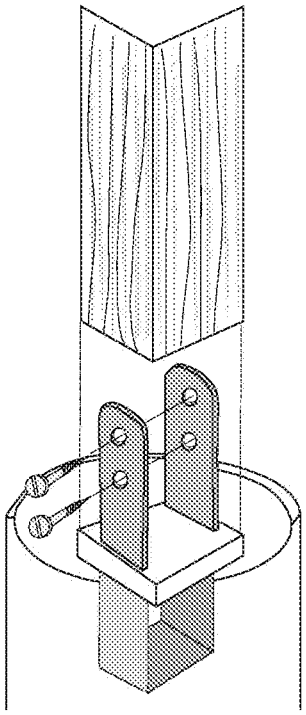
FIGURE 9A
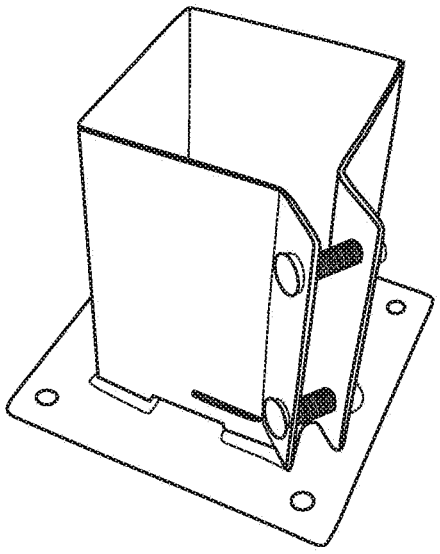
FIGURE 9B
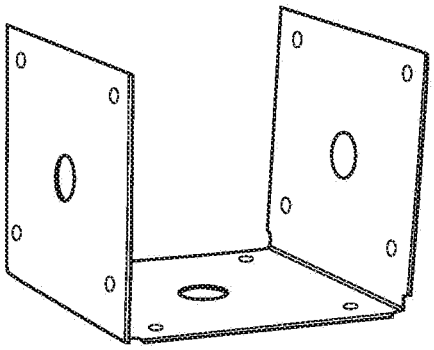
FIGURE 9C
Figure 9

POLYURETHANE FOAM IN FOUNDATION FOOTINGS FOR LOAD-BEARING STRUCTURES

RELATED APPLICATIONS DATA

This application is a Divisional of U.S. patent application Ser. No. 16/434,531 filed Jun. 7, 2019, which is a Continuation of U.S. patent application Ser. No. 15/014,616 filed Feb. 3, 2016, which is a Continuation-in-Part of U.S. patent application Ser. No. 14/318,816 filed Jun. 30, 2014, which claims priority to U.S. Provisional Application No. 61/928,453 filed Jan. 17, 2014.

FIELD OF THE INVENTION

The invention relates to polyurethane foam compositions in raised foundation footings for load-bearing structures and methods of making foundation footings using polyurethane foams.

BACKGROUND OF THE INVENTION

A firm foundation is essential to good performance of buildings and other load-bearing structures. The foundation includes properly installed footings of adequate size to support a structure and prevent excessive settling. Foundation systems are classified as shallow and deep foundations, depending on the depth of the load-transfer member below the super-structure and the type of transfer load mechanism. The required foundation system depends on several factors or conditions such as the strength and compressibility of the site soils, the proposed loading conditions, and the project performance criteria (i.e. total settlement and differential settlement limitations.)

In construction sites where settlement is not a problem, shallow foundations provide the most economical systems. Shallow foundations are typically placed from ground level to 3 meters below ground level or below the frost line. Shallow foundation construction is typically utilized for most residential and light commercial raised floor building sites. FIG. 1, building structure 10 is built on shallow foundation 12. The shallow foundation may be of any suitable shape such as the inverted "T" shape shown. This shape allows more stability.

Where poor soil conditions are found, deep foundations may be needed to provide the required load-bearing capacity and to limit settlement. FIG. 1, building structure 14 is built on a deep foundation 16. Examples of deep foundation systems include driven piles (i.e. pressure-treated timber piles, concrete, or steel), drilled shafts, or micro piles.

Foundation specifications, including footing requirements, are covered in various building codes, and sized in accordance with the building capacity of the soil and the weight of the building. In areas subject to seasonal frost, the bottom of the footing must be placed below the frost line to prevent damage to the footing and structure due to frost heave.

A raised foundation is a foundation which is raised above the plane of the surrounding earth. The main floor of a home or business is built on this foundation. A post and pier foundation system is one example of a raised system. Poured concrete footings are often used in raised foundations. In one example, a wood, metal, plastic, or composite post is set in the ground with concrete and bears the weight of the structure on it. The post is below grade.

In another example, a concrete pier extends from the footing base to above grade. There are several variations of this footing type. FIG. 2 and FIG. 3 depict concrete footings that extend below the frost line to above the ground. Both footings have a wood post 20, typically a 6"×6" post, attached above ground to the concrete pier. For example, in FIG. 2, an anchor bolt 22 is used to connect the post to a concrete footing 24. A gravel base 26 may be used at the bottom of the concrete footing to prevent frost heave. In FIG. 3, a concrete footing 30 is poured in fiber tube 32, a metal post anchor 34 is placed in the concrete, and then the concrete is allowed to set. The above ground portion of the fiber tube is removed after the concrete is set. The metal post anchor 34 connects the post 20 to the concrete footing. Such concrete footings typically extend six inches below the frost line 36 and rest on undisturbed soil 38. The top of the footing is typically at least 6" above grade.

Wood posts are usually attached to the top of the concrete footing above ground. Untreated wood posts will quickly rot if placed below ground due to the presence of water and oxygen which results in fungal attack, for example. Likewise, untreated metal posts placed below ground will rust. Pressure treated wood is available for use in ground contact applications, some having warranties as long as 75 years, however they are expensive. Galvanized metals are used for underground applications. Because such foundations rely on anchors, the structure can be compromised if the anchor bolt becomes loose or breaks.

Concrete has many drawbacks. For instance, concrete takes time to cure, is heavy, porous, and brittle, has high labor costs, has a high carbon footprint, needs large quantities of water, and cannot be poured below 5° C. It is desirable to provide an alternative to concrete footing systems.

The use of polyurethane foams for setting posts has been previously taught, however, the prior art doesn't disclose the use of polyurethane foam for applications where the purpose of the foam is to increase the load bearing capacity of a foundation. U.S. Pat. Nos. 3,403,520 and 5,466,094 disclose the use of polyurethane as a foamable liquid for use in the installation of utility poles, where the pole bears the load and the foam is used to surround the pole and allow for the sole reduction in the size of a hole. While the present invention seeks to do the opposite by expanding the size of the hole, such that the load is spread over a larger area.

BRIEF SUMMARY OF THE INVENTION

The present invention is based on three types of polyurethane footings as herein described. In the first type, as exemplified in FIGS. 5 and 6, the post is placed at the bottom of the hole. In the second type, as exemplified in FIGS. 7 and 8, the post is placed on top of the foam, above grade. In the third type of footing, the post is placed inside the foam footing as in FIG. 10.

In a first embodiment, foundation footing system for a load-bearing structure comprises a hole in a ground, the hole having a bottom and sides, and a post placed on the bottom of the hole and generally centered within the hole, wherein the post extends above the hole, wherein the width of the hole is wider than a width of the post thus forming a gap between sides of the post and the sides of the hole; such that the post occupies no more than 80% of the area at the base of the hole, the foundation further comprising a cured, closed-cell, polyurethane foam surrounding the post, wherein the polyurethane foam fills the gap between the post and sides of the hole, the polyurethane foam comprising a cured mixture of a polyurethane composition comprising polyisocyanate and at least one active hydrogen containing compound. The foundation footing system comprises the post and cured foam, wherein the cured foam provides an adhesive bond strength of at least 1200 pounds per foot embedded and a compressive strength greater than 40 psi.

In another embodiment, method of making a foundation footing system for a load-bearing structure comprises: a) forming a hole in a ground, the hole having a bottom and sides; b) placing a post onto the bottom of the hole such that the post is generally centered within the hole and a gap is formed between sides of the post and the sides of the hole and no more than 80% of the area at the base is occupied by the post; and c) adding a polyurethane composition into the gap, allowing the polyurethane composition to react and form a foam, thereby filling in the gap, and then to cure to form a cured, closed-cell, polyurethane foam, the polyurethane foam mixture comprising polyisocyanate and at least one active hydrogen containing compound, wherein the cured foam provides an adhesive bond strength of at least 1200 pounds per foot embedded.

In a further embodiment foundation footing system for a load-bearing structure comprises a hole in a ground, the hole having a top, bottom, and sides; the foundation further comprising cured, polyurethane foam, wherein the foam fills the hole and extends above the top of the hole to form a foundation footing, the polyurethane foam comprising a cured mixture of a polyurethane composition comprising isocyanate, and at least one active hydrogen containing compound; and further comprising a post placed on and attached to the top of the foam and generally centered on the foam. The foundation footing system comprises the post and foam.

In a further embodiment method of making a foundation footing system for a load-bearing structure comprises: a) forming a hole in a ground, the hole having a top, bottom, and sides; b) placing a polyurethane composition into the hole, allowing the polyurethane composition to react and form a foam, filling in the hole and rising above the hole, and then to cure to form a cured, polyurethane foam footing, the polyurethane foam mixture comprising a polyurethane composition comprising isocyanate, and at least one active hydrogen compound; and further comprising attaching a post to the top of, and generally centered on, the foam.

In preferred embodiments of the above, the foam is a hydrophobic, closed-cell foam that contains at least one water-immiscible component.

Disclosed herein is a foundation footing system. The foundation footing system includes a post configured to be positioned within a hole defined by a ground, the hole having a top, a bottom surface, a side surface extending therebetween, and a width wider than a width of the post such that the side surface of the hole defines a gap between a side surface of the post and the side surface of the hole. The post having a length configured to extend from the bottom surface of the hole to beyond the top of the hole. The system includes a closed-cell polyurethane foam comprising a cured mixture of a polyurethane composition comprising polyisocyanate and at least one active hydrogen containing compound, The cured, closed-cell polyurethane foam is configured to fill the gap between the side surface of the post and the side surface of the hole, directly contact the ground, and provide an adhesive bond strength of at least 1200 pounds per foot embedded when the post has a cross-sectional perimeter of eight inches.

In some embodiments, the cured, closed-cell polyurethane foam provides an adhesive bond strength of least 1300 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam provides an adhesive bond strength of least 1600 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam has a density no greater than 0.075 g/mL. In some embodiments, the cured, closed-cell polyurethane foam has a density no greater than 0.05 g/mL. In some embodiments, the polyurethane composition foam is configured to be cured to touch in about 3 to 20 minutes after combining the polyisocyanate and the at least one active hydrogen containing compound.

In some embodiments, the cured, closed-cell polyurethane foam has a compressive strength of from about 40 psi to about 100 psi. In some embodiments, the cured, closed-cell polyurethane foam is hydrophobic.

Also disclosed herein is a foundation footing system including a post configured to be placed within a hole defined within a ground. The hole having a top defined by the surface of the ground, a bottom surface, a side surface extending therebetween, and a width wider than a width of the post such that the side surface of the hole defines a gap between a side surface of the post and the side surface of the hole. The post having a length configured to extend from the bottom surface of the hole to beyond the top of the hole. The system includes a closed-cell polyurethane foam comprising a cured mixture of a polyurethane composition comprising polyisocyanate and at least one active hydrogen containing compound. The cured, closed-cell polyurethane foam is configured to fill the gap between the side surface of the post and the side surface of the hole and directly contact the ground. The cured, closed-cell polyurethane foam provides an adhesive bond strength of least 1200 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam provides an adhesive bond strength of least 1300 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam provides an adhesive bond strength of least 1600 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam has a density no greater than 0.075 g/mL. In some embodiments, the cured, closed-cell polyurethane foam has a density no greater than 0.05 g/mL. In some embodiments, the polyurethane composition foam is configured to be cured to touch in about 3 to 20 minutes after combining the polyisocyanate and at the least one active hydrogen containing compound. In some embodiments, the cured, closed-cell polyurethane foam has a compressive strength of from about 40 psi to about 100 psi. In some embodiments, the cured, closed-cell polyurethane foam is hydrophobic.

Also disclosed herein is a method of making a foundation footing system. The method includes positioning a post within a hole in a ground. The hole having a top defined by a surface of the ground, a bottom surface, and a side surface extending therebetween. The post is positioned with a first end proximate the bottom surface of the hole, a second end extending beyond the top of the hole, and defining a width narrower than a width of the hole such that the side surface of the hole defines a gap between a side surface of the post and the side surface of the hole. The method includes adding a polyurethane composition into the gap, the polyurethane composition comprising a mixture of a polyisocyanate and at least one active hydrogen containing compound. The method includes allowing the polyurethane composition to cure and form a closed-cell polyurethane foam such that the closed-cell polyurethane foam provides an adhesive bond strength of least 1200 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam provides an adhesive bond strength of least 1300 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester.

In some embodiments, the cured, closed-cell polyurethane foam provides an adhesive bond strength of least 1600 pounds when tested by embedding one foot of a post having a cross-sectional perimeter of eight inches within the polyurethane composition, allowing the polyurethane composition to cure, pressing the post through the cured, closed-cell polyurethane foam, and measuring the adhesive bond strength with a compression-tension tester. In some embodiments, the cured, closed-cell polyurethane foam has a density no greater than 0.075 g/mL.

These and other aspects of the invention are apparent from the following detailed description.

BRIEF DESCRIPTION OF THE DRAWINGS

FIGS. 9A-9C illustrate concrete anchoring systems that can be used with foam footings.

FIGS. 4-11 should be understood as illustrative of various aspects of the invention, relating to the compositions, systems, and methods described herein and/or the principles involved. Some features depicted have been enlarged or distorted relative to others, in order to facilitate explanation and understanding. FIGS. 4-11 do not limit the scope of the invention as set forth in the appended claims.

DETAILED DESCRIPTION OF THE INVENTION

Figure 2:
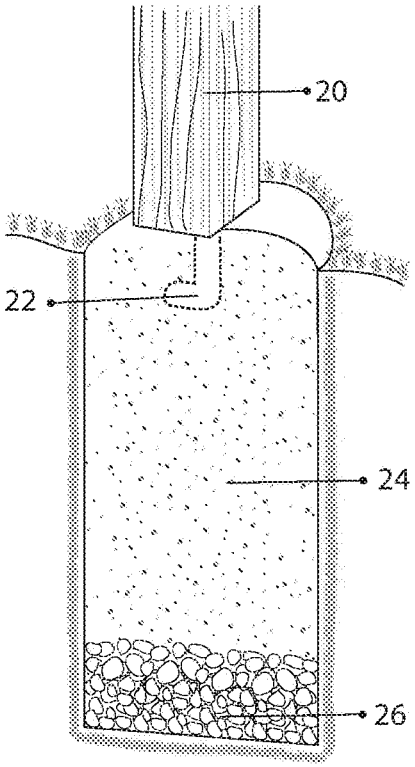
Figure 2 (PRIOR ART)
FIG. 2 illustrates an example of a prior art concrete footing.
Figure 3:
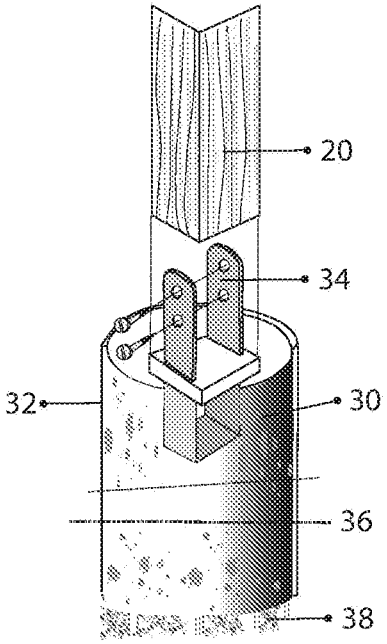
Figure 3 (PRIOR ART)
FIG. 3 illustrates another example of a prior art concrete footing.

Type A, unconfined soil has a compressive strength from about 21 psi to 83 psi. It can support a load of at least 3000 lb./ft and as high as 12,000 lb./ft$^2$. It was discovered that polyurethane foam with similar compressive strength, can have similar load-bearing capacity. This allows for improvements over conventional concrete-based raised foundation systems and footings such as shown in FIGS. 2 and 3. The present invention is therefore directed to the use of polyurethane as footers in foundation systems.

It was further discovered that polyurethane provides improved results over conventional concrete footings. (a) Concrete takes time to cure, for example, standard concrete takes up to 28 days to cure. Polyurethane foam cures in less than five minutes and reaches full strength in 30 minutes. (b) Labor costs are much higher for constructing foundations with concrete than with polyurethane. (c) Concrete is very heavy; thus transportation and handling costs are very high. In addition, the carbon footprint with concrete is very high. Polyurethane foam is much lighter than concrete and hence cheaper to transport. One pound of polyurethane foam replaces about 100 pounds of concrete. (d) Concrete needs large quantities of water. Polyurethane foam does not need water and can be easily used in isolated areas. (e) Concrete is porous and allows water to travel through it. Polyurethane foam can be made impervious to water and will protect the post from rotting or rusting. It also blocks chemicals used to treat the wood from contaminating the soil. (f) Concrete cannot be poured below 5° C.; for every 10° C. reduction in concrete temperature, the time of setting of the concrete doubles, thus increasing the amount of time that the concrete is vulnerable to damage due to freezing. Polyurethane foam can be poured below freezing, as long as the foam components are maintained at about 20 to 25° C. prior to mixing. (g) Concrete is very brittle and, without reinforcement, breaks easily. The polyurethane foam utilized in the present invention is not brittle, does not stress the post, and will not break easily.

The present invention is directed to post and pier foundation footings that allow for wood, metal, plastic, and composite posts to be used both above ground and below ground for load-bearing structures without a concern of rotting, rusting, or deterioration. In one aspect, the foundation footings utilize posts, such as load-bearing wood and metal posts, as well as water-immiscible and hydrophobic, closed-cell, polyurethane foam surrounding the posts. The closed-cell polyurethane foam bonds to a wood post, preventing moisture from reaching the wood and thus preventing fungal attack. The closed-cell polyurethane foam also bonds to a metal post preventing moisture from reaching the metal and thus preventing rust. The closed-cell polyurethane foam may also be bonded to a plastic post to prevent moisture from reaching the plastic, preventing deterioration or weakening of the plastic.

The present invention further allows for posts to be used both above and below ground for load-bearing structures without a concern of the post moving or shifting. That is, the polyurethane foam of the present invention will provide full support for a post for a load-bearing structure.

A load-bearing foundation is one that supports more than its own weight. It transmits force generally from a higher level to a lower level.

The term post includes any suitable support structure, pole, pier, and the like, to create a proper foundation for a load-bearing structure. The post may be wood, metal, plastic, composite material, or any other material capable of supporting the load. The post may be any suitable geometric shape such as round or square. Typical woods used for support posts are pine and fir. Typical metals used for support posts are aluminum and galvanized steel. Typical plastics used for support posts are PVC and ABS. An example of a composite post is fiberglass or carbon fibers with polyester or epoxy resin as a binder.

Figure 1:
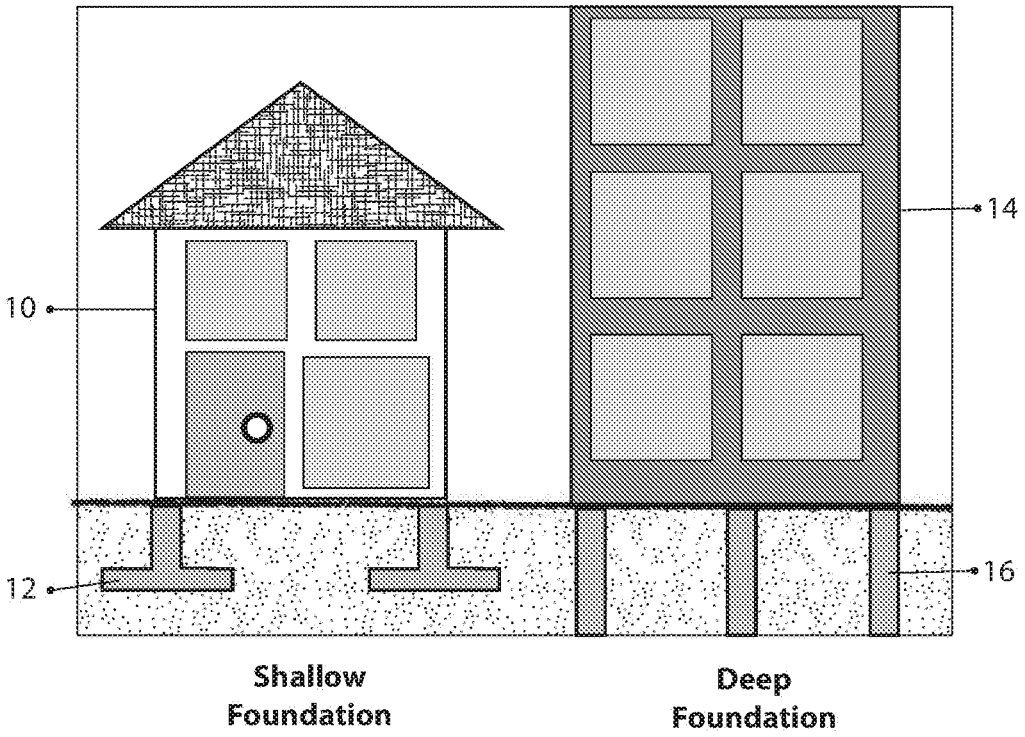
FIG. 1 illustrates examples of shallow and deep building foundations.
Figure 4:
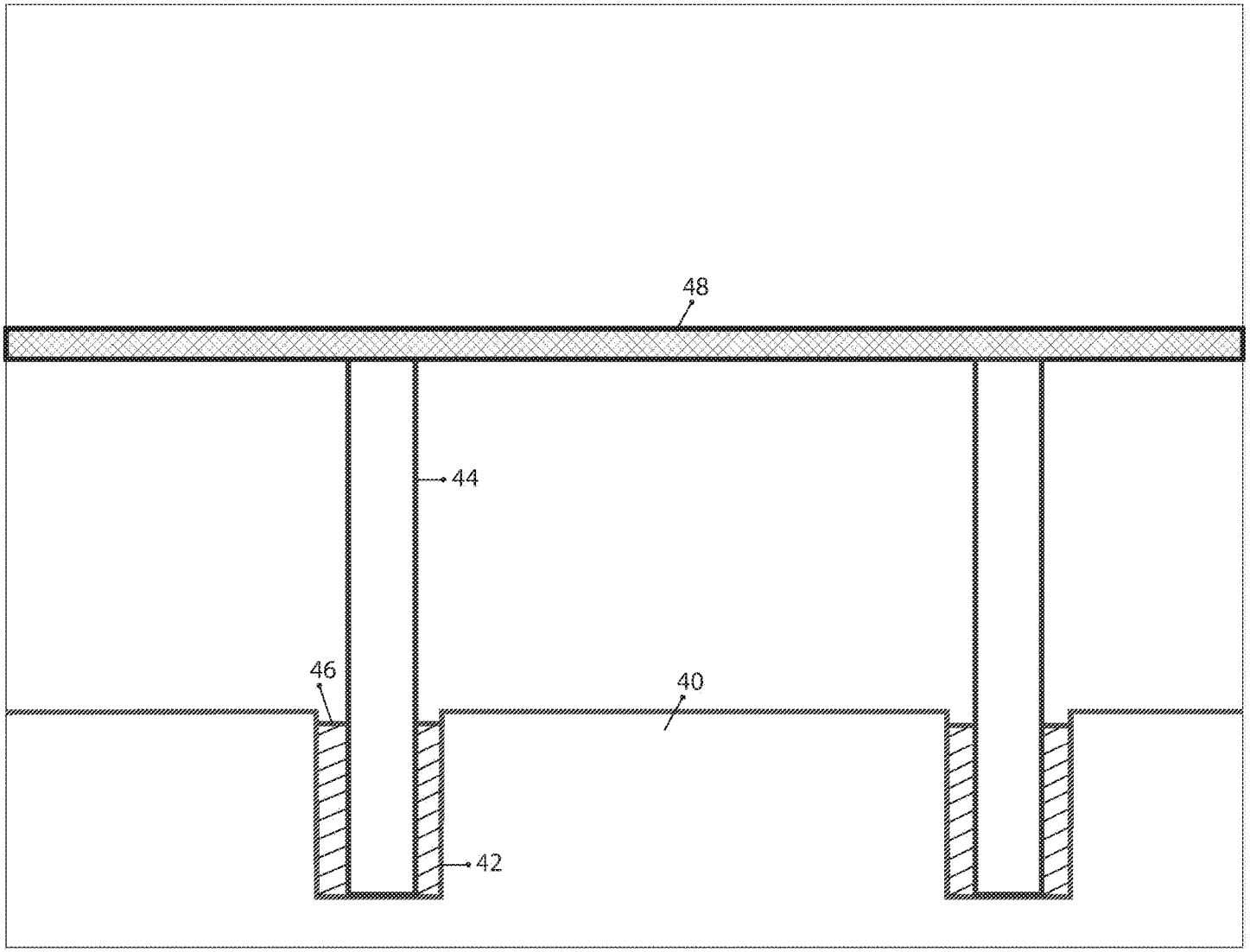
FIG. 4 illustrates an example of a foam and post footing in accordance with aspects of the present invention.

One aspect of the invention is shown in FIG. 4. A post hole 42 is made in the ground (aka earth) 40 to a suitable depth depending on the required foundation specifications. The hole may be made with any suitable device including, but not limited to, an auger. As shown in FIG. 1, the depth will depend on whether a shallow or a deep foundation is required and depends on the weight of the structure and type of ground. Generally holes are round, but other shape holes may be used if desired such as square holes. The diameter of the hole must be large enough to ensure that post can be placed vertically. Further increasing the diameter will increase the load the foundation can support. However the post cannot exceed 80% of the area at the base of the hole, preferably it doesn't exceed 70%.

Typically, though not necessarily, the sides of the hole are uneven, and may contain protruding roots, stones or other debris. To further increase the contact surface area between the soil and the footing, the sides of the hole may be scarified. As the foam rises it will follow the shape of the scarified walls and go into all the grooves. This will increase the friction between the soil and foam. Additionally, the foam will expand against the soil, resulting in compaction in the soil to increase the compressive strength of the soil surrounding the foam.

A concrete footing pad can also be placed at the bottom of the hole and below the post. Larger diameter pads are used for weaker soils to increase the load-bearing capacity. Usually precast concrete, at least four inches thick with a 28 day compressive strength greater than 1200 psi or poured-in-place concrete at least six inches thick with a compressive strength of at least 3000 psi after 28 days, are used. For heavy loads, pads over twelve inches thick may be required. ABS footing pads and other pads that are listed for the required load capacity can also be used.

A post 44 is placed onto the bottom of the hole, either directly, or on a footing pad placed on the bottom of the hole, and generally centered within the hole 42. The post being generally centered means that the post is placed roughly in the middle of the hole; but the post may be slightly off center with the hole so long as the foundation structure is not compromised. Moreover, the shape of the hole and the shape of the post may not correspond to provide the same distance between all sides of the post and all sides of the hole. For instance, a square post may be used in a round hole.

A polyurethane composition is mixed, and immediately poured into the hole around the post. The foam will rise and be tack-free in 3 to 10 minutes at 25° C. It will be fully cured in approximately 30-60 minutes. At this point a load can be placed on the post. The foam components can be mixed in environments from about 30° C. to temperatures well below freezing. The components of the foam just prior to mixing can be at any suitable temperature, but preferably between 20 and 25° C. Typically component temperatures should be at least 15° C. prior to mixing. At lower temperatures, the foam will cure slower and will have a higher foam density when cured. At higher temperatures the foam will cure faster and will be tack-free in less than 3 minutes but the cured density of the foam may be much lower than required for the application. A lower foam density will make the foam weaker. The air temperature can be hot or cold, but soil temperature in the hole typically should not be above 30° C. The foam generates a considerable amount of heat as it cures. This exotherm reaction allows it to cure quickly at low temperatures.

Any premeasured portable mixing/dispensing system can be used to mix and dispense small quantities of the foam. For large holes or for filling many holes, a meter/mix dispenser can be used. In this equipment, the two components can be dispensed and mixed from 5 gallon pails, 55 gallon drums or bulk dispensers. The two components can be mixed with a dynamic or static mixer. This equipment is well known by those familiar with the art.

The polyurethane components react and foam 46 rises up, typically to above the ground surface, and completely surrounds the post 44. After curing, the foam firmly anchors the post in the ground. Any excess foam that rises above ground level may be cut off, if desired. The polyurethane foam allows the post to be placed directly in the hole, preferably below the frost line. The foam holds the post firmly in an upright position and prevents moisture from contacting the post. A building floor 48 may be built on the post 44. To prevent the post from slipping through the foam, the foam must adhere to the post, such that the adhesive force or bond strength is greater than the load placed on the foam. A minimum of 1200 lbs/foot embedded is required. Furthermore, the foam behaves as a cantilever where the soil pressure helps distribute the load across the foam. The result is that the foam is under tension at the base, yet under compression at the top surface of the foam. If the stress in the foam exceeds the flexural strength of the foam, the foam will fail. As such, a minimum flexural strength is needed.

Figure 5:
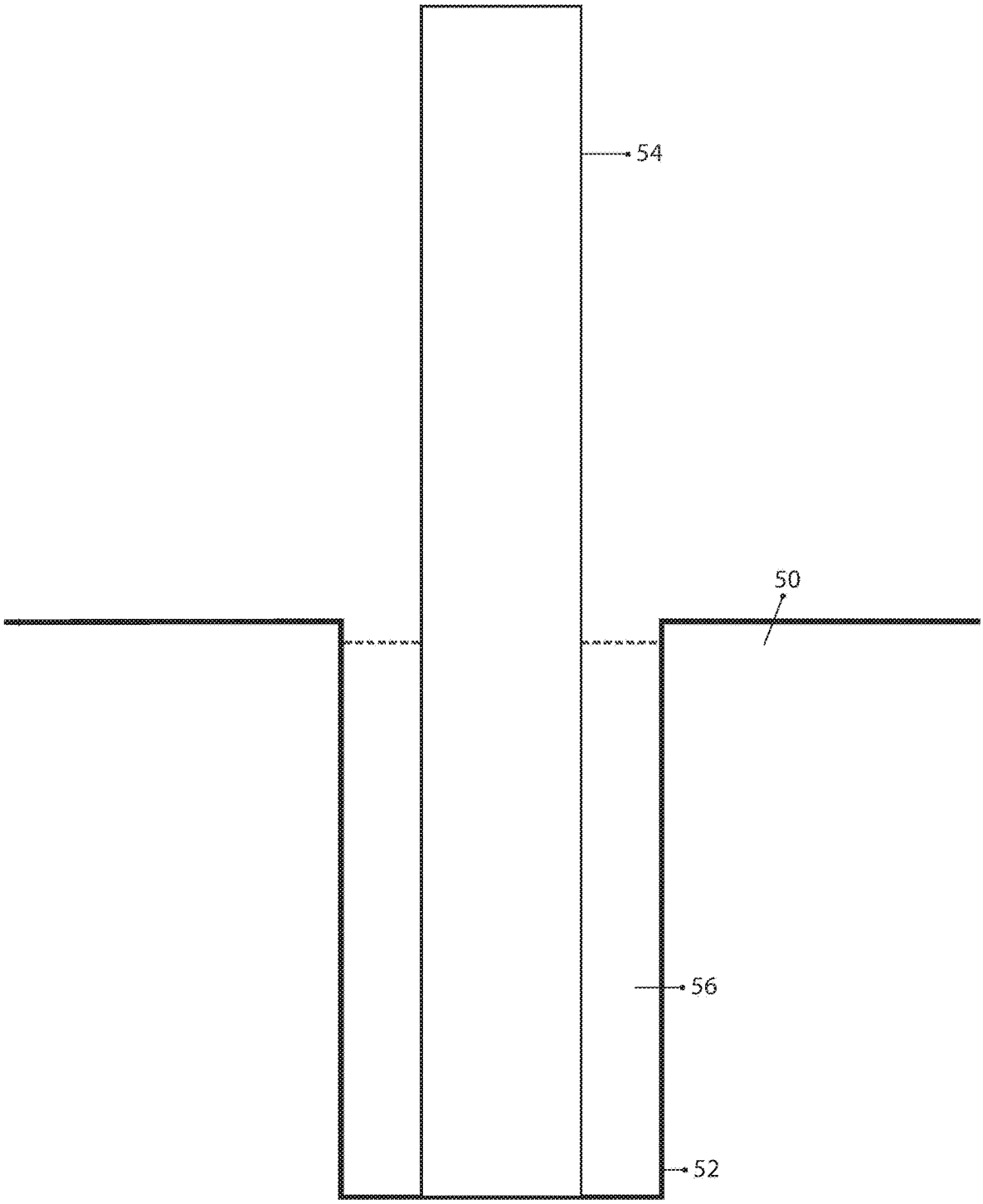
FIG. 5 illustrates an example of a foam and post footing in accordance with aspects of the present invention.
Figure 6:
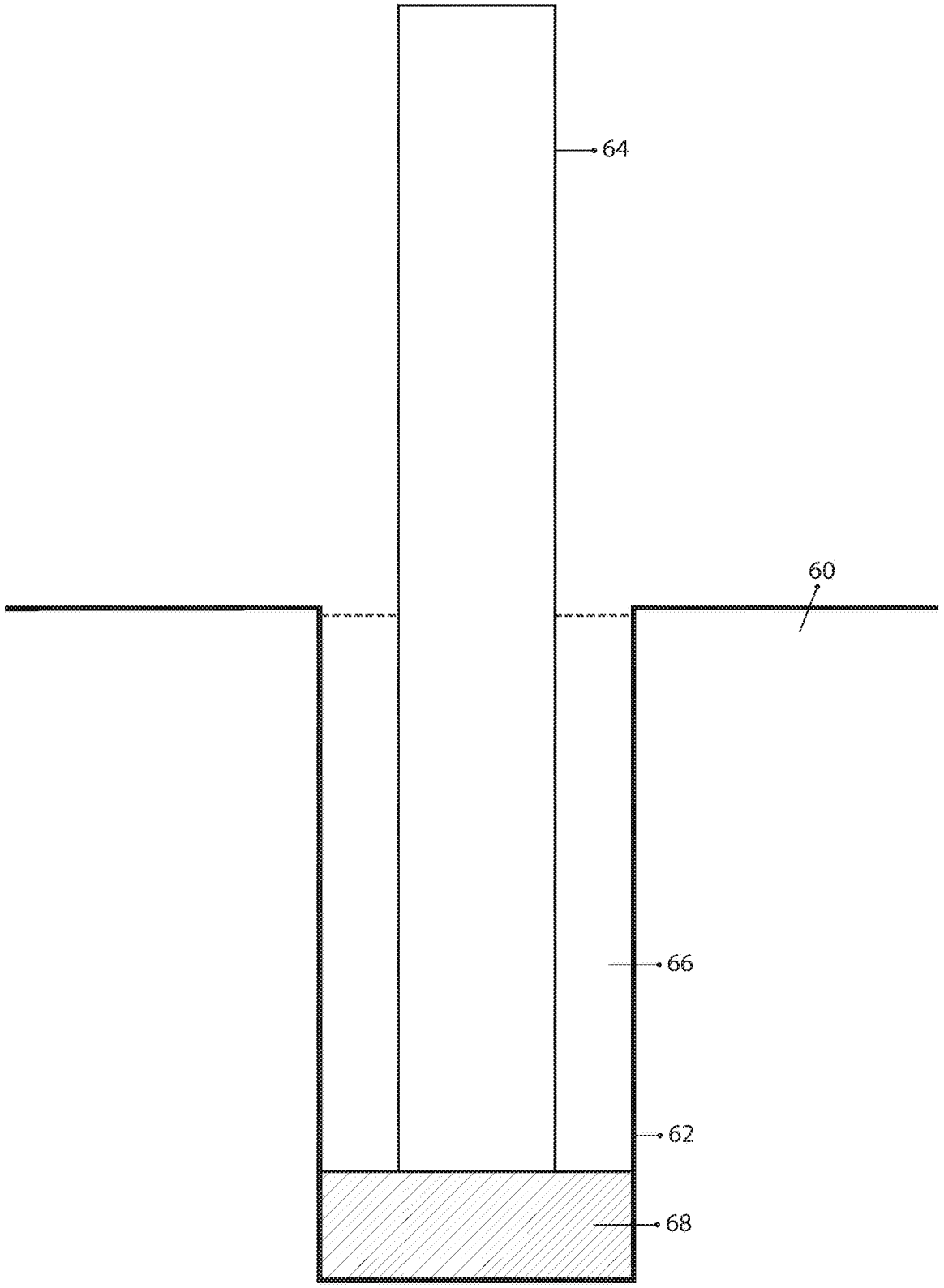
FIG. 6 illustrates another example of a foam and post footing in accordance with aspects of the present invention.

FIGS. 5 and 6 show two aspects of using a post below ground. In FIG. 5, post hole 52 is made in the ground 50. A post 54 is placed onto the bottom of the hole and generally centered within the hole 52. Polyurethane components are combined and poured into the hole. The polyurethane components react and foam 56 rises up. In FIG. 6, post hole 62 is made in the ground 60. A footing pad 68 is placed at the bottom of the hole. A post 64 is placed onto pad 68 at the bottom of the hole and generally centered within the hole 62. Polyurethane components are combined and poured into the hole. The polyurethane components react and foam 66 rises up. As discussed above, pads may be made of any suitable material and would typically be concrete or a polymer, such as ABS.

Figure 7:
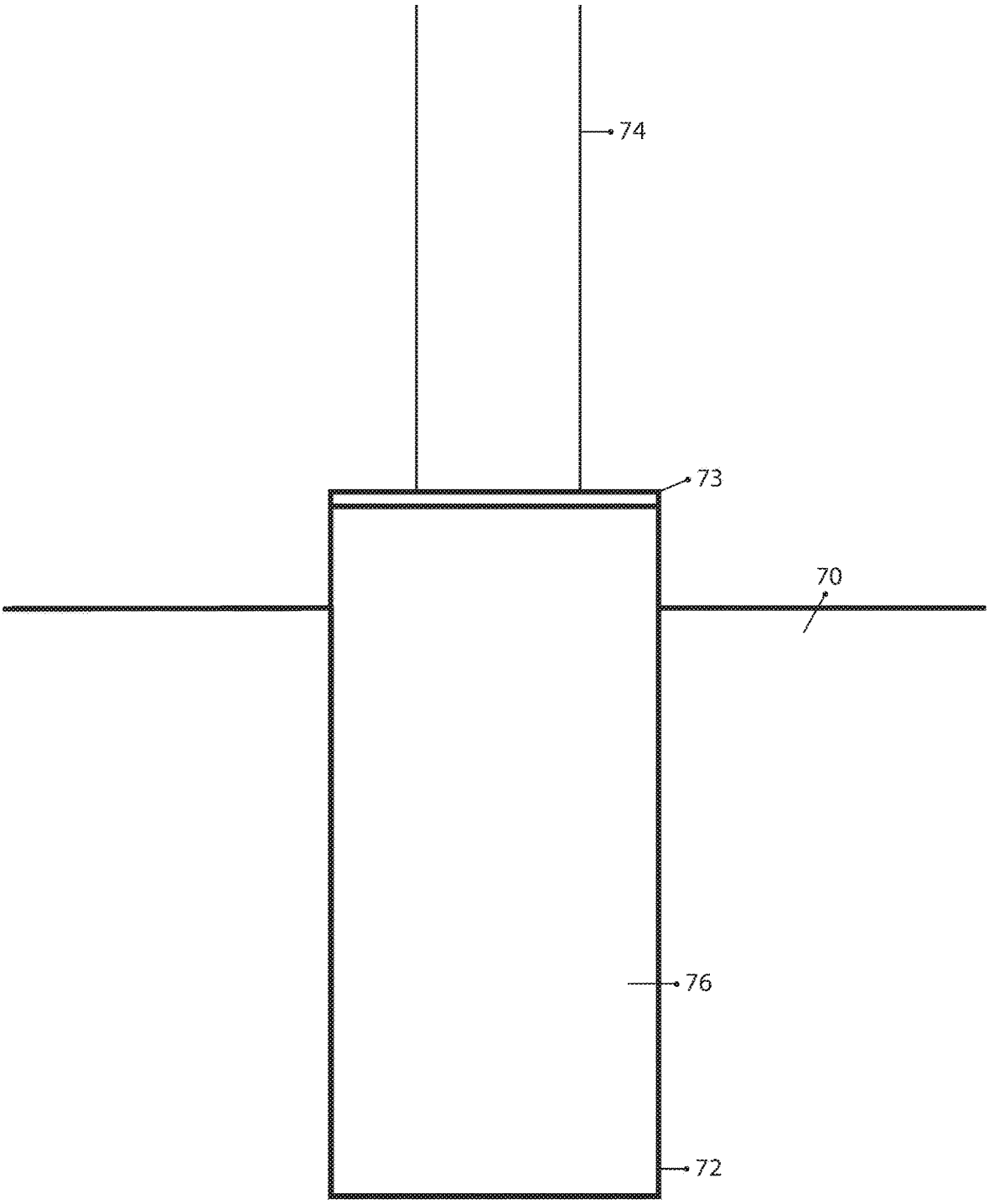
FIG. 7 illustrates an example of a foam footing having a post attached to the top of the foam footing in accordance with aspects of the present invention.
Figure 8:
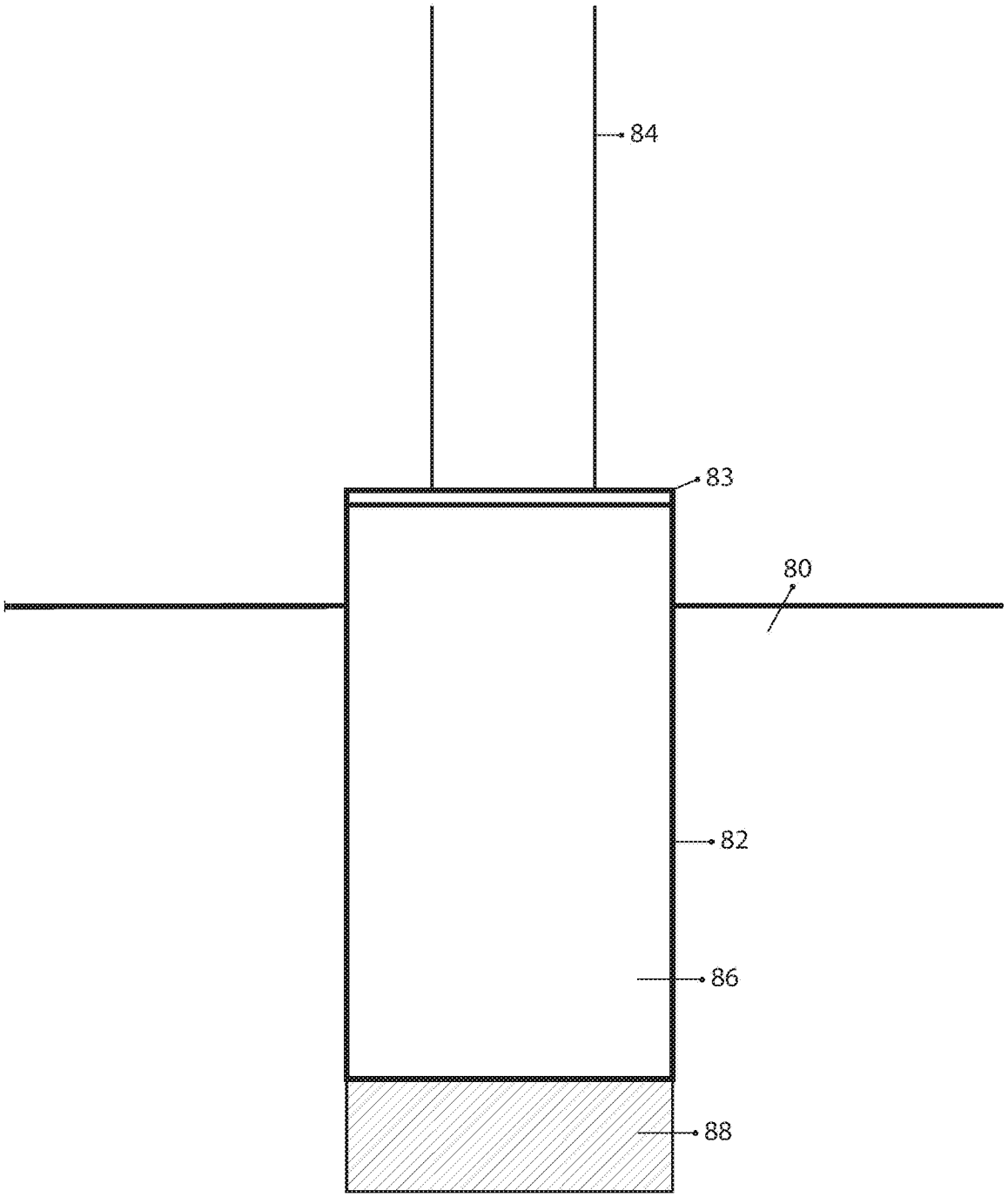
FIG. 8 illustrates another example of a foam footing having a post attached to the top of the foam footing in accordance with aspects of the present invention.

As shown in FIG. 7 and FIG. 8, the polyurethane foam can also be used to completely fill the hole and rise above the hole. The post can then be placed on top of the foam and anchored to it. The foam is the foundation footing. When the post is placed upon cured polyurethane the compressive strength of the foam is critical. The foam must not collapse under the weight of the structure based upon it. A top plate 83 can be used to evenly distribute the load over the foam. The minimum compressive strength needed is 40 psi, but to decrease the size of the footing or increase the load capacity of the footing a stronger foam, 60 psi or greater, is preferred.

In FIG. 7, a post hole 72 is made in the ground 70 to a suitable depth depending on the required foundation specifications. Polyurethane components are combined and poured into the hole. The polyurethane components react and foam 76 rises up, typically from one to three feet above ground. A round cardboard forming tube, the same diameter as the hole, such as a Sonotube, can be used to shape the foam when it rises above ground. When the foam has cured, it can be cut level to the ground or up to three feet above the ground. It is usually cut above the ground to prevent the post from degrading by contacting the wet soil.

A footing pad 73 can be placed on top of the tube so that the foam presses up against the pad as it rises. The foam must bond to the pad as it cures. The pad helps to distribute the load on the post over the surface of the foam that is under the pad. The floor of a structure can be built on top of the post 74. When the post is on top of the footing pad, the compressive strength of the foam and the adhesions of the foam to the soil are important factors in the load-bearing capacity of the footing.

Post 74 may be attached to the foam footing or the plate on top of the foam footing in any suitable manner. For example, brackets or adhesives may be used to attach the post.

Similarly in FIG. 8, a post hole 82 is made in the ground 80 to a suitable depth. A footing pad 88 is placed at the bottom of the hole. Polyurethane components are combined and poured into the hole. The polyurethane components react and foam 86 rises up as discussed above. A flat footing pad 83, as discussed above may be used so that the foam cures flat and the pad is bonded to it. Post 84 is then attached to the pad as discussed above.

Many of the anchoring systems used with concrete footings can be used with foam footings. Examples of these are in FIG. 9.

Figure 10:
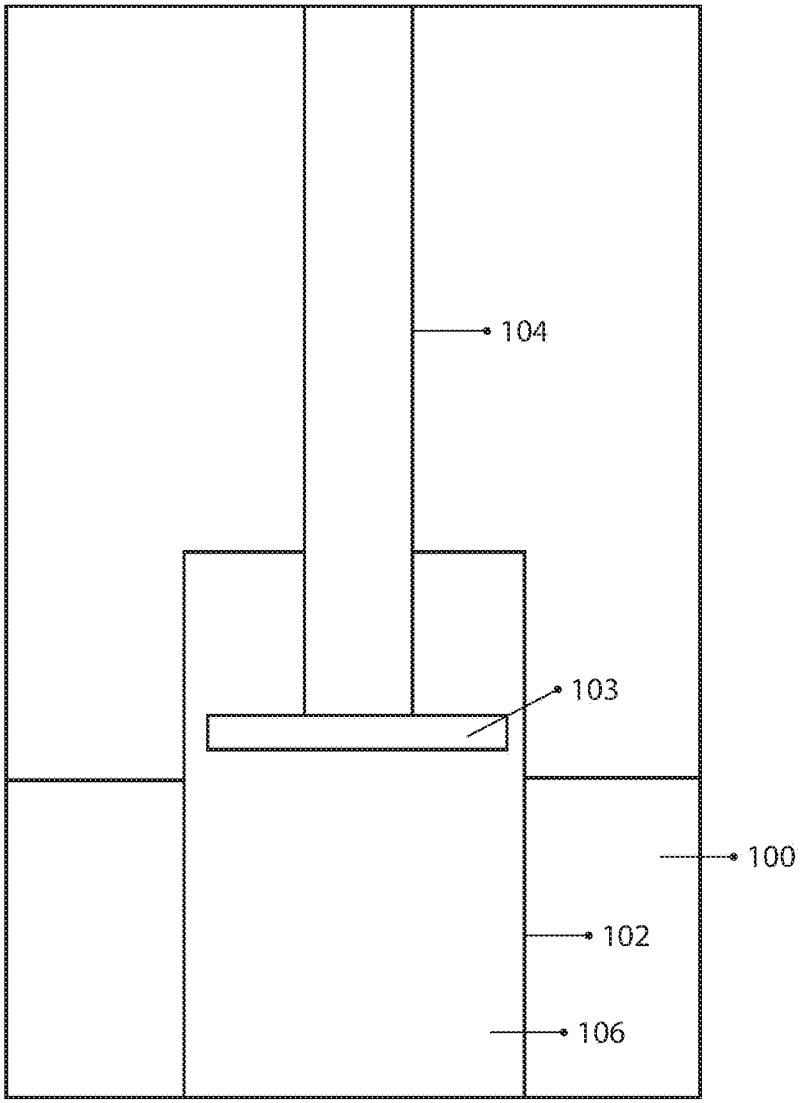
FIG. 10 is an anchoring system where the post is imbedded in the foam.

FIG. 10 shows an anchoring system where the post is imbedded in the foam. A footing pad is attached to the bottom of the post. Foam fills the hole to the desired level. The pad is placed on top of the foam and leveled. Foam is poured on top of the pad and cured.

Figure 11:
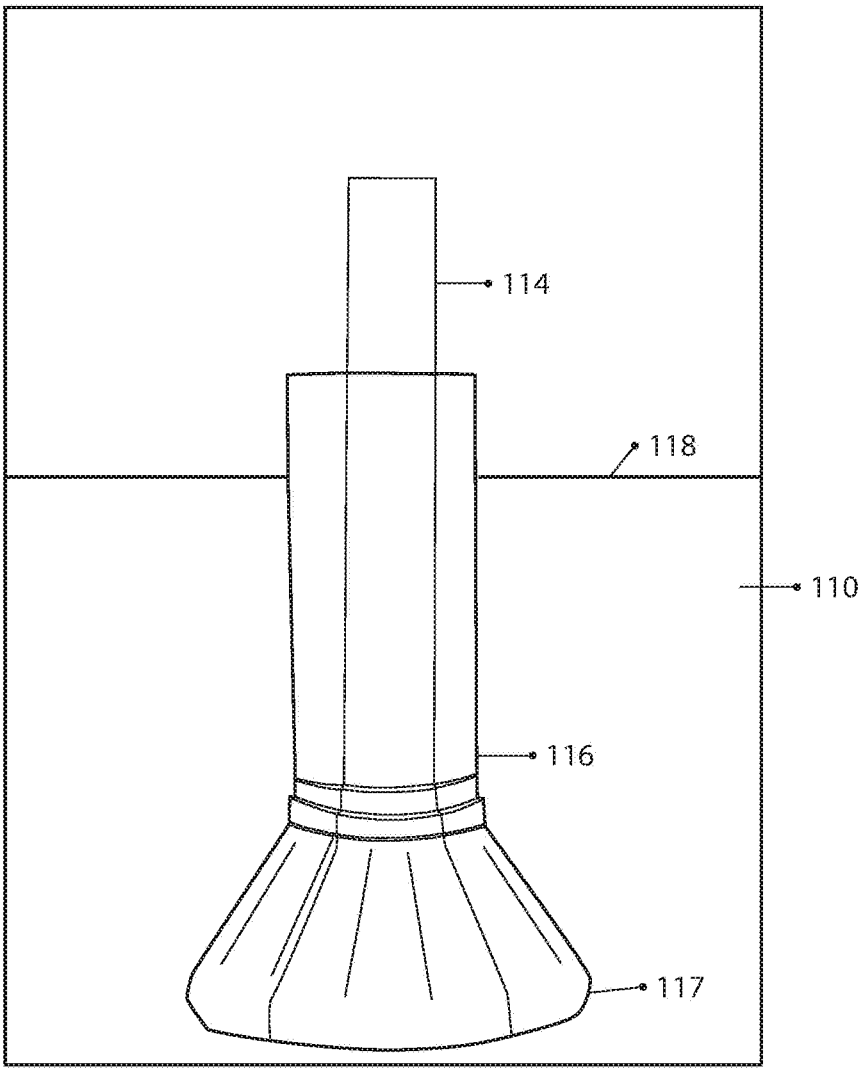
FIG. 11 shows the foam used to replace concrete in prefabricated and pre-molded footing forms.
Figure 12:
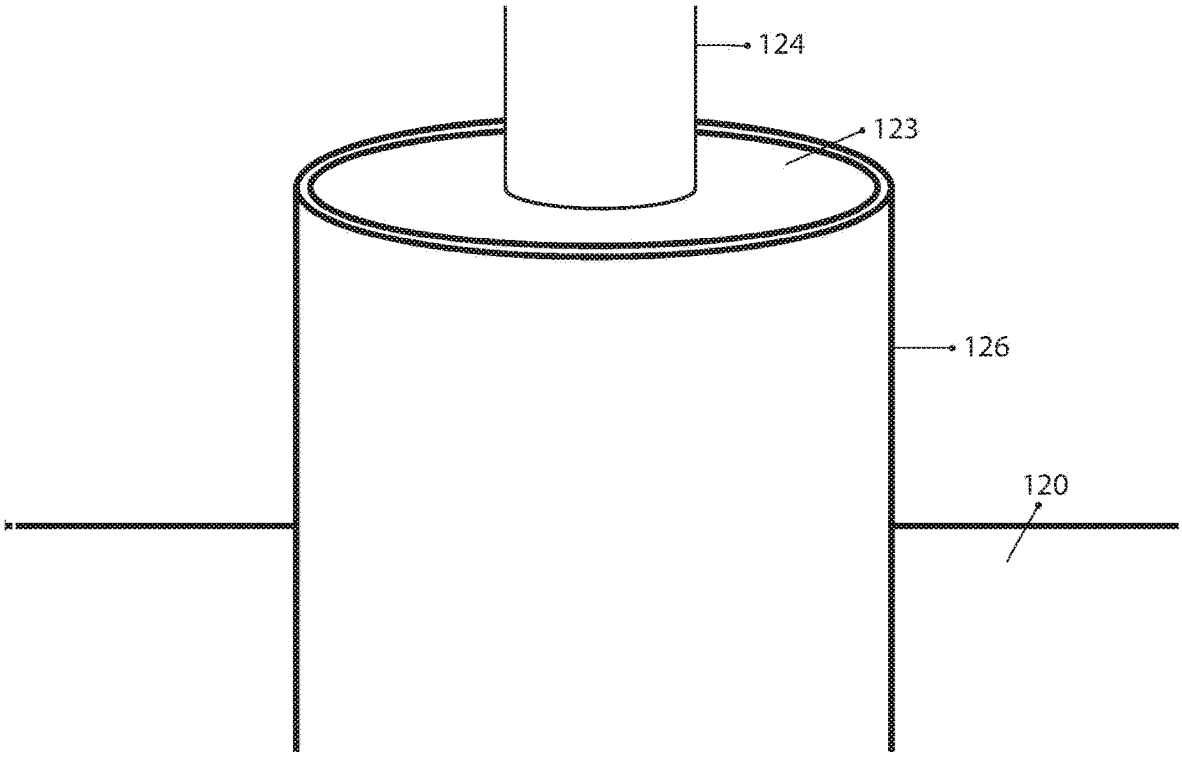
FIG. 12 shows the preferred space between the footing pad on top of the foam footing and the edge of the foam. This space should be small so the load on the post will be distributed over the largest area possible.

In FIG. 11, a prefabricated box, such as a wood box, attached to a cardboard construction tube can be used. Foam is used to replace the concrete. Pre-molded footing forms can also be used.

The post with the footing pad attached to its bottom can be placed at the bottom of the hole or at the top. It can be placed anywhere in between. It is preferable to place it closer to the top of the hole to make leveling of the foam easier.

When prefabricated footing forms are used, the post can be placed above ground or below ground as described above. The foam footings can also be cured inside of the prefabricated footing form during the manufacture of the footing form or at the construction site.

Deep foundations are greater than 3 meters below ground level. In deep foundations driving piles have a higher load-bearing capacity than drilling shafts. Driving the piles compress the surrounding soil, causing greater friction against the soil next to the pile. Injecting the polyurethane composition between the drilling shaft and the soil will increase the friction and the load-bearing capacity of the pile.

Depending on the load, the soil and the compressive strength of the foam, a footing pad may need to be placed under the foam footing. When the post is at the bottom of the hole, a concrete footing pad can be used. When the post is not touching the soil at the bottom of the hole, the post must be attached to a treated wood, ABS, or any other type of footing pad that will not substantially increase the load on the foam.

The method to determine the proper size and load-bearing capacity required for footings is the same for foam, concrete, or any other load-bearing footing material. First it must be established how much total weight each footing will support. The type of soil that will be under the footing and the load-bearing capacity of this soil must be determined. As discussed above, the compressive strength of the foam must also be considered. For higher loads or weaker soils, larger footings are required. An engineer may be required to calculate the footing requirements for higher loads or in areas where the load-bearing capacity of the soil is less than 1500 lb./f$^2$. Determining the requirements of the footing can easily be obtained by those skilled in the art. The footing transmits the load into the soil. The lower the bearing capacity of the soil, the wider the footing needs to be.

It is very important that the foam used for this application, in wet or damp soil is water-repellant and hydrophobic. "Water-repellant" refers to the mixed isocyanate and polyols composition in the liquid state and while it is curing. "Hydrophobic" refers to the polyurethane foam when it is cured.

The hole to be filled with the polyurethane foam may contain ground water or runoff water. Standard polyurethane foam will absorb and react with this soil water. This will produce a footing having low density and low strength. The foam density and strength must be closely controlled. The present invention utilizes special polyurethane foam forming compositions which are resistant to the undesired side reaction with ground water. Foams that are not water-repellant can be used when the soil is not wet and the hole to be filled does not contain ground water or runoff water. They can also be used to make prefabricated footings.

U.S. Pat. No. 3,564,859 first introduced the concept of adding a non-volatile water-immiscible material to polyurethane components so that the properties of the resultant product are not affected excessively in the presence of groundwater. U.S. Pat. No. 4,966,497 improved on the above by removing halogenated hydrocarbon blowing agents from the formulation. The above patents are incorporated by reference in their entirety. It was discovered for the present application that adding a hydrophobic surfactant to the formulation provides the desired properties for the polyurethane foam used for footers.

Water-Repellency

The composition of the present invention utilizes conventional materials such as polyisocyanate and active hydrogen containing compounds, but for wet or damp conditions, also includes water-immiscible components. The water-immiscible components provide the water-repellency of the polyurethane foam composition in the liquid state, while it is curing. The water-immiscible components can be any of a large number of materials or mixtures of materials. Preferably the water-immiscible component is a liquid having a low vapor pressure which is substantially non-reactive under the usual conditions of foam formation with either the active hydrogen or the isocyanate components used to form the polyurethane compositions. Materials which react with either or both of the polyurethane components may comprise part or most of the water-immiscible component.

"Water-immiscible" means that the solubility in water at about 70° F. is less than about 5 grams per 100 grams and preferably less than about 1 gram per 100 grams of water. In a preferred embodiment, the water-immiscible component has no measurable solubility in water. Among the water-immiscible components are those described in U.S. Pat. No. 3,968,657, hereby incorporated by reference in its entirety. Among the water-immiscible components having a low vapor pressure are the higher alkanes ($C_8$ and above), crude oil, petroleum oils and higher petroleum fractions of all kinds (both pure and crude), asphalts, tars, petroleum refining bottom or residues. Components that are comprised primarily of aromatic or aliphatic hydrocarbons are water-immiscible. Also included are materials such as coal tar pitch, wood tar pitch, tall oil, tall oil derivatives, vegetable oil, vegetable oil derivatives, and waxes. Solid materials that are water-insoluble and that can be dissolved in a water-immiscible liquid. Halogenated hydrocarbons and halogen derivatives can also be used.

Water-immiscible solvents can also be used. Suitable water-immiscible solvents include blowing agents such as HCFC's, pentane, and hexane as well as high boiling solvents such as high flash aromatic naptha in amounts up to about 15% by weight of the total composition.

Sufficient compatible water-immiscible components should be present to inhibit the reaction with water. Excessive water-immiscible components or incompatible water-immiscible components may result in unacceptable deterioration of the physical characteristics of the final foam and should be avoided. The desired polyurethane foam can be obtained from compositions containing 10%-80% by weight of the water-immiscible components. Preferably, the amount of water-immiscible components is in the range of 30% to 60% by weight of the polyurethane foam forming compositions.

Hydrophobicity

It is preferred that the cured foam is closed-cell. Water should not be able to pass through the foam. This is particularly important when the post is in-ground and surrounded by the foam.

Surfactants help to control the precise timing and the size of the foam cells. Within each foam formulation, a minimum level of surfactant is needed to produce commercially acceptable foam. In the absence of a surfactant, a foaming system will normally experience catastrophic coalescence and exhibit an event known as boiling. With the addition of a small amount of surfactant, stable yet imperfect foams can be produced; and, with increasing surfactant concentration, a foam system will show improved stability and cell-size control.

Most cured, rigid polyurethane foams contain closed cells. Higher density rigid foams have thicker cell walls and thus have a higher percentage of closed cells than lower density rigid foams. The inclusion of a hydrophobic surfactant improves the uniformity and size of the cell structure. It also increases the closed cell content; thus, increasing the hydrophobicity of the foam. It is important that lower density foams that require hydrophobicity have a sufficient concentration of closed cells to make them hydrophobic. Foams suitable for use in some footing applications have foam densities as low as 0.035 gm/cc and a compressive strength as low as 40 psi. Foams with densities higher than 0.10 gm/cc and compressive strengths higher than 100 psi can be used, but may be cost prohibitive in many applications. Preferred foam densities are higher than about 4 lb./ft.$^3$ Preferred compressive strengths are higher than about 60 psi. There is no preferred upper limit for either the foam density or the compressive strength. However, the cost will increase as the foam density increases. Foams can be formulated with specific properties, such as compressive strength and foam density for specific applications.

Surfactants

The foams of the invention are prepared using a surfactant, particularly a hydrophobicity inducing surfactant. Typically, hydrophobicity inducing surfactants are polysiloxane-polyalkylene oxide copolymers, usually the non-hydrolyzable polysiloxane-polyalkylene oxide copolymer type. The polyoxyalkylene (or polyol) end of the surfactant is responsible for the emulsification effect. The silicone end of the molecule lowers the bulk surface tension. When a hydrolyzable surfactant, which contains Si—O linkages between the silicon and polyether groups, is contacted with water, the molecule breaks apart to form siloxane and glycol molecules. When this occurs, the individual molecules no longer exhibit the proper surfactant effects. Non-hydrolyzable type surfactants, which contain a water stable Si—C bond between the silicon and polyether chain, are thus preferred.

Hydrophobicity inducing surfactants include: Goldschmidt Chemical Corp. of Hopewell, Va. products sold as B8110, B8229, B8232, B8240, B8870, B8418, B8462; Organo Silicons of Greenwich, Conn. products sold as L6164, L600 and L626; and Air Products and Chemicals, Inc. products sold as DC5604 and DC5598. Preferred surfactants are B8870, B8110, B8240, B8418, B8462, L626, L6164, DC5604 and DC5598. B8870 and B8418 from Goldschmidt Chemical Corp. are more preferred; B8418 is most preferred.

Non-hydrophobic inducing surfactants, such as Dow Corning DC190 and DC 193 can be used in dry, above ground and prefabricated applications.

The surfactant is used in the range of 0.1-5% of the total formulation. Generally, lower density foams require more surfactant than higher density foams.

Isocyanates

In principle, a wide range of isocyanates may be used to prepare polyurethane foams of the invention such as, for example, toluene diisocyanate (TDI), diphenylmethane diisicyanate, polymethylenepolyphenylene polyisocyanate, hexamethylene diisocyanate (HMDI), 1, 5-naphthylene diisocyanate, xylylene diisocyanate, hydrogenated polymethylenepolyphenylene polyisocyanate, and mixtures thereof. Isocyanate prepolymers can also be used. Polymeric MDI is the preferred isocyanate used in this invention.

Polyols

Polyols useful in the preparation of the polyurethane foams used in this invention can be either one or a combination of polyether, polyester polyols, or polyalkyldiene polyols, or derived from reaction of excess of such polyols, alone or in combination with isocyanate function compounds. The polyols can be diols, triols, tetrols or polyols with higher functionality. They can be used alone or in combination. Representative examples of useful polyols include polyoxypropylene polyol, polyalkylene polyol, and polypropylene glycols. They can be amine polyols, sucrose polyols, glycerol polyols, sorbitol polyols, or combinations. The polyols used can be aliphatic or aromatic.

Most commercially available polyols have a polyether or polyester backbone. They are usually hydrophilic and soluble in water. Water-immiscible and hydrophobic polyols available include those with hydrocarbon and polybutadiene backbones. Bio based, water-immiscible, polyols are also available.

Catalysts

Tertiary amines and organo-tin compounds are preferably used as catalysts. The particular tertiary amine and organo-tin catalyst used in obtaining the hydrophobic polyurethane foams of the present invention is not critical, and any combination of components readily known to those skilled in the art may be used. Examples of suitable tertiary amines include triethylenediamine, triethylamine, N-methylmorpholine, N-ethylmorpholine and N,N,N'N'-tetramethylbutanediamine. Suitable organo-tin catalysts include stannous octoate and dibutyltin dilaurate.

Up to about 5% by weight of a catalyst can be used bases on the total reaction material weight. Preferably the catalyst should range from 0.01 to about 1.0% by weight. Tertiary amine and organo-tin compounds are preferred.

Blowing Agents

Examples of blowing agents that can be used in the present invention include water, low boiling alkanes such as butane and pentane, acetone and liquid carbon dioxide. Halogenated blowing agents (HCFC's) can also be used, even though they are not preferred. Water is the preferred blowing agent in this invention. Blowing agents are used between 1 and 20% by weight and more preferably between 1 and 15% based on the total weight of the formulation.

Additional Components

Additional components that may be used in the present polyurethane foams include, for example, crosslinking agents; fillers, including but not limited to carbon black and calcium carbonate; coloring dyes, antioxidants, fungicides, pesticides and anti-bacterial additives, flow agents, viscosity modifiers, foam control agents, plasticizing agents, moisture scavengers or repellants or retardants including but not limited to any vegetable oil such as soybean oil, castor oil, linseed oil, sunflower oil, cashew nut oil, or dimer acid, modified soybean oil, modified castor oil, modified linseed oil, modified sunflower oil, modified cashew nut oil, modified dimer acid, polybutadiene, hydroxyl terminated polybutadiene; adhesion promoters, temperature stabilizers, and ultraviolet radiation stabilizers.

Flame retardants may also be added to render the foamed product flame retardant. Suitable flame retardants include tris(chloroethyl) phosphate, tris(2-chloroethyl) phosphate, tris(dichloropropyl) phosphate, chlorinated paraffins, tris (chloropropyl) phosphate, phosphorus-containing polyols, and brominated aromatic compounds such as pentabromodiphenyl oxide and other brominated polyols.

The polyurethane composition has a low viscosity, typically 500 to 5000 cps when measured with a Brookfield Viscometer at 25° C. temperature. The low viscosity, in part, allows the composition to be easily poured into the hole. The composition can be made water-repellant and hydrophobic to prevent external moisture from becoming part of the foam structure and reducing the compressive strength. To ensure that the composition is less sensitive to moisture, specific moisture repellants or retardants can be added to the pre-foamed liquid. While the moisture repelling compounds are added to repel water or moisture, the repellants can also react into the backbone and thus may be added in large percentages. The polyurethane will start to react as soon as the two components are mixed together, expansion may begin between 5 and 120 seconds after the reaction begins.

The polyurethane composition is added to the hole, reacts, and foams up. It is noted that some of the reaction may begin prior to adding to the hole. For in-ground applications, it is preferred that the resulting polyurethane foam is water-repellant hydrophobic and closed-cell, to prevent water or other liquids from passing through the foam to rot wood or corrode metal. The resulting polyurethane foam then preferably cures to touch in about 3 to 4 minutes after mixing and is fully cured in less than 2 hours after mixing. By changing the catalyst concentration, the gel time and tack-free time of the foam can be made faster or slower, depending on the working time required for a particular application. The gel time can be as long as 20 minutes and as fast as 30 seconds.

The polyurethane foam has good adhesion to wood, metal, plastics and composite materials, soil, clay, gravel and rocks. This is evident from the results listed in Table 2 below.

The polyurethane foam also provides an abrasive surface to increase friction against soil. This helps prevents movement of the footing through the soil.

The compressive strength is also important to prevent damage to the foam as a greater load is placed on the footing and it moves through the soil. The compressive strength of the foam is usually between 40 psi and 100 psi for most applications. However, it may be higher, depending on the footing requirements.

The foamable compositions utilized in the present invention can vary with the requirements mentioned above. The following are representative of such formulations. All parts are by weight.

The examples below are provided to help illustrate the diversity of the inventive process and are not given for any purpose of setting limitations or defining the scope of the invention. Examples of how the foam could be composed as well methods for applying the foam are outlined.

Foam Example 1

Component 1

| | |
|---|---|
| 4,4' diphenylmethane diisocyanate | 100% |

Component 2

| | |
|---|---|
| Sucrose Based Polyether Polyol | 60.8% |
| Petroleum Hydrocarbon | 30% |
| High Flash Naptha Solvent | 5% |
| Hydrophobic Silicone Surfactant | 2% |
| Catalyst | 0.2% |
| Water | 2% |

The mixed viscosity is 1100 cps. This composition has a cured foam density of 0.10 gm/cc, a compressive strength of 100 psi, the adhesive bond strength is 2000 lbs/foot embedded and the flexural strength is 75 psi. This foam is a water-repellant, hydrophobic closed cell foam.

Foam Example 2

Component 1

| | |
|---|---|
| 4,4' diphenylmethane diisocyanate | 100% |

Component 2

| | |
|---|---|
| Sorbitol Polyol | 42.9% |
| Amine Polyol | 25% |
| Vegetable Oil | 20% |
| Hydrophobic Surfactant | 5% |
| Catalyst | 0.1% |
| Water-Repellant Blowing Agent, e.g. Pentane | 7% |

The mixed viscosity is 4350 cps. The foam density is 0.06 gm/cc. The compressive strength is 60 psi and the adhesive bond strength is 1750 lbs/foot embedded. This foam is a water-repellant, hydrophobic closed cell foam.

Foam Example 3

Component 1

| | |
|---|---|
| 4,4'diphenylmethane diisocyanate | 100% |

Component 2

| | |
|---|---|
| Sorbitol Polyol | 50% |
| Polyether Polyol | 42% |
| Non-Hydrophobic Surfactant | 3% |
| Catalyst | 1% |
| Water | 4% |

The mixed viscosity is 1500 cps. The foam density is 0.05 gm/cc. The compressive strength is 55 psi and the adhesive bond strength is 1300 lbs/foot embedded. This foam is an example of a non-water-repellant rigid, polyurethane foams. It could be used above grade, in dry soils and to make prefabricated footings.

Foam Example 4

Component 1

| | |
|---|---|
| 4,4'diphenylmethane diisocyanate | 100% |

Component 2

| | |
|---|---|
| Glycerol Polyol | 70% |
| Polypropylene Glycol | 23.8% |
| Non-Hydrophobic Surfactant | 3% |
| Catalyst | 0.2% |
| Water | 3% |

The mixed viscosity is 2500 cps. Foam density is 0.085 gm/cc. The compressive strength is 80 psi and an adhesive bond strength of 1900 lbs/foot embedded. This foam is an example of a non-water-repellant rigid, polyurethane foams. It could be used above grade, in dry soils and to make prefabricated footings.

The adhesion bond strength of the present composition compared with the prior art compositions was tested. A mold was made by gluing a plywood base to a 6" diameter, 24" long cylindrical cardboard tube. A pressure treated, 2×2" (nominal) post was secured in the centre of the cylindrical cardboard tube by screwing it to the base. The test foam was mixed according to the correct ratio and poured into the mold to cure. After 24 hours, the base and cylindrical cardboard tube were cut away from the foam. The foam was trimmed such that the post extended 1" through the base of the foam, and then the top of the foam was cut such that the length of the remaining foam was 1 foot. The test specimen was then loaded on a base plate, which had a 2"×2" hole to allow the post to move through, prior to being placed into a compression-tension tester. Load was applied to the top of the post at a rate of 0.005 mm/sec until failure. Failure occurred when a large decrease in load was needed to push the post through the foam or when the foam began to compress.

TABLE 1

Adhesion strength test of the present compositions versus prior art compositions.

| | Foam Example #5 | Prior art foam #1 | Prior art foam #2 |
|---|---|---|---|
| 250-350 MW polyether triol | | 12 | |
| 1350-1600 MW polyether diol | | | 12 |
| Amine initiated polyether polyol | 10-20% | 40 | 40 |
| Sucrose based polyether polyol | 35-55% | 12.5 | 12.5 |
| Castor oil based polyol | 5-25% | | |
| 3500-4000 MW polyether diol | | 15 | |
| 350-450 MW polyether diol | | | 15 |
| High flash Naptha solvent | 5-10% | | 10 |
| Hydrophobic silicone surfactant | 0-1% | 1 | 1 |
| Catalyst | 0.1-0.5% | 0.5 | 0.5 |
| $H_2O$ | 1.5-2.5% | 2 | 2 |
| Vegetable oil | 0-15% | | |
| Foam density | 0.075 g/mL | 0.059 g/mL | 0.055 g/mL |
| Compressive strength | 71.61 psi | 63.32 psi | 77.87 psi |
| Adhesion | >1628 lbs/foot | 1094 lbs/foot | 1052 lbs/foot |
| Failure mode | compression | adhesion | adhesion |

The results show that the bond strength of the present composition is significantly higher than the prior art compositions.

By adjusting the concentration of the various raw materials, the physical and chemical properties of the foam can be changed. For example, decreasing the catalyst concentration will slow down the gel time. Increasing the water concentration will decrease the foam density and decrease the compressive strength. Changing the properties of the foam is easily done by those familiar with the art.

Method of Application—Example 1

A hydraulic auger affixed with an 8" bit is used to dig a hole 4' deep and 10" in diameter. A nominal 6"×6" pressure treated post is placed in the hole such that the base of the post rests on the base of the hole, the spacing between the sides of the post and the sides of the hole is generally equal and the post is vertically level. During the casting of the foam, bracing is used to hold the post in place. The foam, packaged in two separate containers, is mixed at the prescribed ratio by pouring one jug into another and shaking until well mixed. The mixed foam is then poured into the space between the post and the side of the hole and allowed to foam and cure. After curing, the foam acts as a footing, and the post is attached to the beams and joints of a structure which carries load.

Method of Installation—Example 2

A two-man auger affixed with a 6" bit is used to dig a hole 3' deep and 8" in diameter. A nominal 6"×6" pressure treated post is placed in the hole such that the base of the post rests on the base of the hole, the spacing between the sides of the post and the sides of the hole is generally equal and the post is vertically level. During the casting of the foam, bracing is used to hold the post in place. The foam, packaged in a divided bag, is mixed at the prescribed ratio removing the physical barrier between the two components and shaking until well mixed. The mixed foam is then poured into the space between the post and the side of the hole and allowed to foam and cure. After curing, the foam acts as a footing, and the post is attached to the beams and joints of a structure which carries load.

Method of Installation—Example 3

A two-man auger affixed with an 8" bit is used to dig a hole 2.5' deep and 10" in diameter. A nominal 8"×8" pressure treated post is placed in the hole such that the base of the post rests on the base of the hole, the spacing between the sides of the post and the sides of the hole is generally equal and the post is vertically level. During the casting of the foam, bracing is used to hold the post in place. The foam, packaged in a divided bag, is mixed at the prescribed ratio removing the physical barrier between the two components and shaking until well mixed. The mixed foam is then poured into the space between the post and the side of the hole and allowed to foam and cure. After curing, the foam acts as a footing, and the post is attached to the beams and joints of a structure which carries load.

Method of Installation—Example 4

A clamp style post hole digger is used to dig a hole 3' deep and 8" in diameter. The side walls of the hole are roughen using a shovel. A nominal 4"×4" pressure treated post is placed in the hole such that the base of the post rests on the base of the hole, the spacing between the sides of the post and the sides of the hole is generally equal and the post is vertically level. During the casting of the foam, bracing is used to hold the post in place. The foam, packaged in two separate containers, is mixed at the prescribed ratio by pouring one jug into another and shaking until well mixed. The mixed foam is then poured into the space between the post and the side of the hole and allowed to foam and cure. After curing, the foam acts as a footing, and the post is attached to the beams and joints of a structure which carries load.

Method of Installation—Example 5

A two-man auger affixed with an 6" bit is used to dig a hole 3' deep and 8" in diameter. A galvanized steel post is placed in the hole such that the base of the post rests on the base of the hole, the spacing between the sides of the post and the sides of the hole is generally equal and the post is vertically level. During the casting of the foam, bracing is used to hold the post in place. The foam, packaged in a divided bag, is mixed at the prescribed ratio removing the physical barrier between the two components and shaking until well mixed. The mixed foam is then poured into the space between the post and the side of the hole and allowed to foam and cure. After curing, the foam acts as a footing, and the post is attached to the beams and joints of a structure which carries load.

Method of Installation—Example 6

A two-man auger affixed with an 6" bit is used to dig a hole 3' deep and 8" in diameter. A two component polymeric material is mixed as directed and poured into the hole to form a 6" deep pad. A nominal 6"×6" pressure treated post is placed in the hole such that the base of the post rests on the top of the polymeric pad, the spacing between the sides of the post and the sides of the hole is generally equal and the post is vertically level. During the casting of the foam, bracing is used to hold the post in place. The foam, packaged in a divided bag, is mixed at the prescribed ratio removing the physical barrier between the two components and shaking until well mixed. The mixed foam is then poured into the space between the post and the side of the hole and allowed to foam and cure. After curing, the foam acts as a footing, and the post is attached to the beams and joints of a structure which carries load.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method of making a foundation footing system, the method comprising:

positioning a post within a hole in a ground, the hole having a top defined by a surface of the ground, a bottom surface, and a side surface extending therebetween, and the post positioned with a first end proximate the bottom surface of the hole, a second end extending beyond the top of the hole, and defining a width narrower than a width of the hole such that the side surface of the hole defines a gap between a side surface of the post and the side surface of the hole;

adding a polyurethane composition into the gap, the polyurethane composition comprising a mixture of a polyisocyanate and at least one active hydrogen containing compound; and allowing the polyurethane composition to cure and form a closed-cell polyurethane foam such that the closed-cell polyurethane foam exhibits an adhesive bond strength of least 12 pounds per square inch.

2. The method of claim 1, wherein the cured, closed-cell polyurethane foam exhibits an adhesive bond strength of least 13 pounds per square inch.

3. The method of claim 1, wherein the cured, closed-cell polyurethane foam exhibits an adhesive bond strength of least 16 pounds per square inch.

4. The method of claim 1, wherein the cured, closed-cell polyurethane foam has a density no greater than 0.075 g/mL.

5. The method of claim 1, wherein the cured, closed-cell polyurethane foam has a density no greater than 0.05 g/mL.

6. The method of claim 1, wherein the polyurethane composition foam is configured to be cured to touch in from about 3 to about 20 minutes after combining the polyisocyanate and the at least one active hydrogen containing compound.

7. The method of claim 1, wherein the cured, closed-cell polyurethane foam exhibits a compressive strength of from about 40 psi to about 100 psi.

8. The method of claim 1, wherein the cured, closed-cell polyurethane foam is hydrophobic.

9. A method of making a foundation footing system, the method comprising:

positioning a post within a hole in a ground, the hole having a top defined by a surface of the ground, a bottom surface, and a side surface extending therebetween, and the post positioned with a first end within the hole, a second end extending beyond the top of the hole, and defining a width narrower than a width of the hole such that the side surface of the hole defines a gap between a side surface of the post and the side surface of the hole;

adding a polyurethane composition into the gap, the polyurethane composition comprising a mixture of a polyisocyanate and at least one active hydrogen containing compound; and allowing the polyurethane composition to cure and form a closed-cell polyurethane foam, wherein the cured, closed-cell polyurethane foam is configured to fill the gap between the side surface of the post and the side surface of the hole, and exhibit an adhesive bond strength of at least 1200 pounds per foot embedded when the post has a cross-sectional perimeter of eight inches.

10. The method of claim 9, wherein the cured, closed-cell polyurethane foam is configured to exhibit an adhesive bond strength of at least 1300 pounds per foot embedded when the post has a cross-sectional perimeter of eight inches.

11. The method of claim 9, wherein the cured, closed-cell polyurethane foam is configured to exhibit an adhesive bond strength of at least 1600 pounds per foot embedded when the post has a cross-sectional perimeter of eight inches.

12. The method of claim 9, wherein the cured, closed-cell polyurethane foam has a density no greater than 0.075 g/mL.

13. The method of claim 9, wherein the cured, closed-cell polyurethane foam has a density no greater than 0.05 g/mL.

14. The method of claim 9, wherein the polyurethane composition foam is configured to be cured to touch in from about 3 to about 20 minutes after combining the polyisocyanate and the at least one active hydrogen containing compound.

15. The method of claim 9, wherein the cured, closed-cell polyurethane foam method a compressive strength of from about 40 psi to about 100 psi.

16. The method of claim 9, wherein the cured, closed-cell polyurethane foam is hydrophobic.

* * * * *